US005664023A

United States Patent [19]

Button

[11] Patent Number: 5,664,023

[45] Date of Patent: Sep. 2, 1997

[54] LOW TCR WIRE IN HIGH POWER AUDIO COILS

[75] Inventor: Douglas J. Button, Champaign, Ill.

[73] Assignee: JBL Incorporated, Northridge, Calif.

[21] Appl. No.: 338,434

[22] Filed: Nov. 14, 1994

[51] Int. Cl.[6] ..... H04R 25/00

[52] U.S. Cl. ..... 381/194; 381/192

[58] Field of Search ..... 381/194, 192, 381/195, 196, 197

[56] References Cited

U.S. PATENT DOCUMENTS

| | | | |
|---|---|---|---|
| 3,884,290 | 5/1975 | McCubbin | 164/82 |
| 4,104,061 | 8/1978 | Roberts | 75/211 |
| 4,327,257 | 4/1982 | Schwartz | 381/197 |

*Primary Examiner*—Sinh Tran
*Attorney, Agent, or Firm*—J. E. McTaggart

[57] ABSTRACT

For electric coil windings, particularly in moving coils such as the voice coil of a heavy duty bass loudspeaker or other electro-acoustic transducer, the present invention has found metallic materials, as alternatives to copper or aluminum in the voice coil wire, that can provide increased available maximum SPL (sound pressure level) exceeding an empirical limit, just under 120 dB/1 m, that has been found to apply to various loudspeakers of known art regardless of efficiency and structural differences. Through study of known art regarding this limitation and theoretical analysis of the factors in voice coil structure and design that limit the maximum attainable SPL, a novel basis for selecting voice coil wire material has been developed. By selecting wire material for low TCR (temperature coefficient of resistance) along with suitable resistivity and density, rather than for low resistivity alone which has conventionally dictated copper or aluminum, the present invention has led to the identification of new wire materials that can increase the available SPL. Such materials include alloys of aluminum containing between two and five component basic metals selected from the following group: magnesium, silicon, manganese, zinc and copper. The alloy Al Mg(3.5%) in extruded form yields maximum SPL 1.5 dB above that of pure aluminum and 3.32 dB above that of pure copper.

9 Claims, 3 Drawing Sheets

$$SPL = 112 + 10\,\mathrm{Log}\left[\frac{k_5\,Tr\,Sd^2\,Rme\,Ch\,Cd}{Fc\,(1 + k_1\,Tr)\left(Mmx + \frac{(\pi k_2 k_3 k_4 Ch^2 Cd^2 Rme))^2}{FX^2\,Fp}\right)}\right]$$

Glossary of Symbols

- Cd Mean diameter of the voice coil, inches
- Ch Height or axial length of the coil, inches
- Fp Packing factor of the coil windings ( .95 for edge wound .7 for round wire)
- Fc Cooling factor: how well the design does at taking heat from the surface of the coil (about 2.0 in Vented-gap woofers, around 3.0 for typical designs); includes Pi; when divided by square inches yields $C^\circ/W$
- FX Flux lines passing through the surface of the coil, Maxwells
- $k_1$ Thermal Coefficient of resistivity (TCR, .00393 for Cu and Al), 1/C°
- $k_2$ modifier for mixed units (-7.84E12)
- $k_3$ Resistivity of voice coil wire ($2.9 \times 10^{-6}$ for Al, $1.74 \times 10^{-6}$ for Cu)
- $k_4$ Density of wire material, Kg/Cu inch (.0442 for Al, .145 for Cu)
- $k_5$ $Po/2\pi c$
- Po Density of air (1.21Kg/cu m)
- c The speed of sound (343m/s)
- Mmx The part of the moving mass that does not include the coil
- Re DC resistance of voice coil, Ohms
- Rme Motor strength defined as $B^2L^2/Re$
- B Flux density over the surface of the voice coil, Tesla
- L The length of the wire in the coil, meters
- Sd The projected area of the diaphragm, Sq meters
- SPL Sound pressure level, dB
- Tr The temperature rise of the voice coil above room temperature, Celcius $$SPL = 112 + 10 \text{ Log} \left[ \frac{k_5 \, Tr \, Sd^2 \, Rme \, Ch \, Cd}{Fc \, (1 + k_1 \, Tr)\left(Mmx + \frac{(\pi k_2 k_3 k_4 Ch^2 Cd^2 Rme))^2}{FX^2 \, Fp}\right)} \right]$$

Glossary of Symbols

Cd Mean diameter of the voice coil, inches

Ch Height or axial length of the coil, inches

Fp Packing factor of the coil windings ( .95 for edge wound .7 for round wire)

Fc Cooling factor: how well the design does at taking heat from the surface of the coil (about 2.0 in Vented-gap woofers, around 3.0 for typical designs); includes Pi; when divided by square inches yields C°/W FX Flux lines passing through the surface of the coil, Maxwells $k_1$ Thermal Coefficient of resistivity (TCR, .00393 for Cu and Al), 1/C°

$k_2$ modifier for mixed units (-7.84E12)

$k_3$ Resistivity of voice coil wire ($2.9 \times 10^{-6}$ for Al, $1.74 \times 10^{-6}$ for Cu)

$k_4$ Density of wire material, Kg/Cu inch (.0442 for Al, .145 for Cu)

$k_5$ $Po/2\pi c$

Po Density of air (1.21Kg/cu m)

c The speed of sound (343m/s)

Mmx The part of the moving mass that does not include the coil

Re DC resistance of voice coil, Ohms

Rme Motor strength defined as $B^2L^2/Re$

B Flux density over the surface of the voice coil, Tesla

L The length of the wire in the coil, meters

Sd The projected area of the diaphragm, Sq meters

SPL Sound pressure level, dB

Tr The temperature rise of the voice coil above room temperature, Celcius

*FIG. 1*

| Wire Type | Max SPLmax | Max - 3 dB | Temp C max - 3 dB | $k_1$ TCR | $k_3$ Res | Spec Grav | $k_4$ dens |
|---|---|---|---|---|---|---|---|
| Cu pure | 121.25 | 118.25 | 264 | 0.0041 | 1.70E-06 | 8.90 | 0.1457 |
| Alum pure | 123.07 | 120.07 | 264 | 0.0041 | 2.90E-06 | 2.70 | 0.0442 |
| Al Mg (1.25 sheet) | 123.67 | 120.67 | 353 | 0.003 | 3.90E-06 | 2.74 | 0.0449 |
| Al Mg (1.25 extruded) | 124.03 | 121.03 | 437 | 0.0024 | 4.80E-06 | 2.74 | 0.0449 |
| Al Mg (2.25) | 123.94 | 120.94 | 405 | 0.0026 | 4.50E-06 | 2.69 | 0.0440 |
| Al Mg (3.5 sheet) | 124.38 | 121.38 | 496 | 0.0021 | 5.30E-06 | 2.67 | 0.0437 |
| Al Mg (3.5 extruded) | 124.57 | 121.57 | 546 | 0.0019 | 5.70E-06 | 2.67 | 0.0437 |
| Al Mg (.5) Si (.5) | 123.57 | 120.57 | 323 | 0.0033 | 3.50E-06 | 2.70 | 0.0442 |
| Al Cu (4.0) Mg (.6) Si (.4) Mn (.6) | 124.02 | 121.02 | 455 | 0.0023 | 5.00E-06 | 2.80 | 0.0458 |
| Al Zn (10) Cu (1.0) Mn (.7) Mg (.4) | 123.96 | 120.96 | 455 | 0.0023 | 4.90E-06 | 2.91 | 0.0476 |

*FIG. 2*

LOW TCR WIRE IN HIGH POWER AUDIO COILS

FIELD OF THE INVENTION

The present invention relates to the field of electroacoustics and more particularly it relates to basic concepts in the design of loudspeakers for achieving maximum possible SPL (sound pressure level) with attention directed to the management of temperature effects and the selection of wire material for the voice coil winding.

BACKGROUND OF THE INVENTION

In seeking maximum possible SPL from acoustic transducers such as heavy duty low frequency loudspeakers, it has been found empirically in tests and studies of examples of the best of known art, that there appears to be a "piston band" wall or barrier that has heretofore limited the obtainable SPL to just under 120 dB/1 m (sound pressure level of 120 dB referred to 20 micropascals, measured at a distance of 1 meter from the loudspeaker) regardless of differences in design approaches and variations in efficiency, magnetic flux, voice coil form factor, size, etc.

Temperature plays a key role in this limitation: as the SPL is increased, the $I^2R$ power loss dissipated in the voice coil increases. This increase is accelerated by the positive TCR (temperature coefficient of resistance) of the metal voice coil wire. To the extent that the resultant heat is not removed immediately, the temperature of the voice coil rises. If sufficient heat sinking is provided the temperature will stabilize at a point of thermal equilibrium, otherwise a thermal runaway condition will result in the temperature rising continuously to an ultimate level of destruction.

The maximum available SPL is limited to that producing a maximum working temperature level of sustainable equilibrium that approaches, with an acceptable margin of safety, a potentially destructive ultimate temperature limit determined by such factors as thermal properties of adhesives, bobbins and other voice coil materials. Differential expansions, distortions, can distort the voice coil dimensionally to the point of destructive interference with surrounding magnet poles, depending on pole gap clearances, and repeated expansion/contraction from temperature cycling can cause deterioration and shortened useful life of the loudspeaker.

In the case of constant voltage drive, the increasing coil resistance reduces the current, the power efficiency, and the acoustic power output, and accordingly limits the maximum available SPL.

In the case of constant current drive, the $I^2R$ power dissipation increases regeneratively because as I remains constant R increases, further increasing dissipation and temperature. This potentially destructive runaway condition is at best difficult and at worst impossible to control with conventional heat removal systems, given the unfavorable heat sinking characteristics of the moving voice coil structure as contrasted with fixed coils such as those in transformers where heat-sinking of the windings can be enhanced, for example by encapsulation in heat-conductive materials.

The wire most commonly used in voice coils is made from copper or aluminum, both of which have a positive TCR of 0.0041 (20°–100° C.) in pure form. Conservative design practice addresses the worst case of continuous maximum power over a prolonged period of time, along with a high ambient temperature, even though the long-term average loading factor from typical voice and music operation may be relatively low.

Designers have adopted copper and aluminum (and occasionally silver) for voice coil windings almost exclusively on the basis of low resistivity at room temperature (20° C.), and have simply accepted the TCR resistance rise. The potential of utilizing wire material with lower TCR and suitable density, despite higher initial resistivity, has not been recognized heretofore.

DISCUSSION OF RELATED KNOWN ART

The "brute-force" approach of simply making the voice coil and/or the entire motor system larger and more massive in efforts to increase maximum SPL capability involves tradeoffs such as loss of high frequency performance, and has been generally exploited to practical limits with regard to materials, size, weight, cost, etc.

In addition to the "brute-force" approach, there have been numerous approaches to protecting the loudspeaker voice coil from over-dissipation and destruction while pushing the limits of SPL capability: these include (a) costly and complex protective shutdown systems to prevent destruction of the loudspeaker from excessive temperature rise in the voice coil, and (b) unusual methods of heat removal.

The wire for voice coil winding has been made in special cross-sectional shapes such as square, rectangular or flat ribbon in an effort to reduce the coil resistance and/or mitigate the temperature rise.

U.S. Pat. No. 4,933,975 to Button (the present inventor) discloses means for conducting heat from a loudspeaker voice coil gap comprising a system of heat-radiating vanes in the vicinity.

U.S. Pat. No. 5,042,072, also to Button, discloses a self-cooling system that air-cools the voice coil from its own movement.

U.S. Pat. No. 3,991,286 to Henricksen exemplifies the use of a voice coil form made of material having high thermal conductivity.

U.S. Pat. No. 4,210,778 to Sakurai et al utilizes a heat pipe extending from the voice coil region to a reflex port of the enclosure.

U.S. Pat. No. 4,757,547 to Danley addresses air-cooling of voice coils with fans and the like.

Additionally, numerous other patents and publications testify to the difficulties encountered in attempting to achieve new high levels of SPL capability.

OBJECTS OF THE INVENTION

It is a primary object of the present invention to provide a fundamental improvement in the basic design of voice coil winding structures for moving coils, directed particularly to realizing novel voice coil structure that enables loudspeakers to deliver extremely high maximum SPL (sound pressure level) exceeding that attained by loudspeaker products of known art.

It is a further object to seek and identify alternative material to replace conventional copper and aluminum for voice coil windings based on findings that certain metal alloys having relatively low TCR along with suitable density Can potentially provide increased maximum SPL despite higher initial resistivity.

SUMMARY OF THE INVENTION

Comprehensive theoretical and empirical investigation and analysis of factors limiting SPL have been reported by the present inventor in a paper "Maximum SPL from Direct Radiators" presented at the Annual Convention of the Audio Engineering Society in San Francisco, Calif., on Nov. 12, 1994. This work .has uncovered a fallacy in the traditional practice of selecting voice coil wire material based on resistivity alone, and has developed a global equation for estimating the maximum available SPL that takes into account the TCR of the wire. From this equation it has been found that a key alterable factor is the product of the TCR and the resistivity times density product of the wire. Consequently it has become possible to identify certain alloy metal materials that have a TCR substantially lower than that of copper and aluminum and that have the potential of enabling the design of loudspeakers having maximum SPL capability exceeding that found in known art utilizing conventional copper or aluminum voice coil windings.

BRIEF DESCRIPTION OF THE DRAWINGS

The above and further objects, features and advantages of the present invention will be more fully understood from the following description taken with the accompanying drawings in which:

FIG. 1 gives an equation for SPL (sound pressure level) that has been derived in conjunction with the present invention, along with a glossary of the symbols in the equation.

FIG. 2 is a table showing maximum SPL calculated from the equation of FIG. 1 for an exemplary group of different metals and alloys utilized as voice coil wire material.

DETAILED DESCRIPTION

Figure 3:
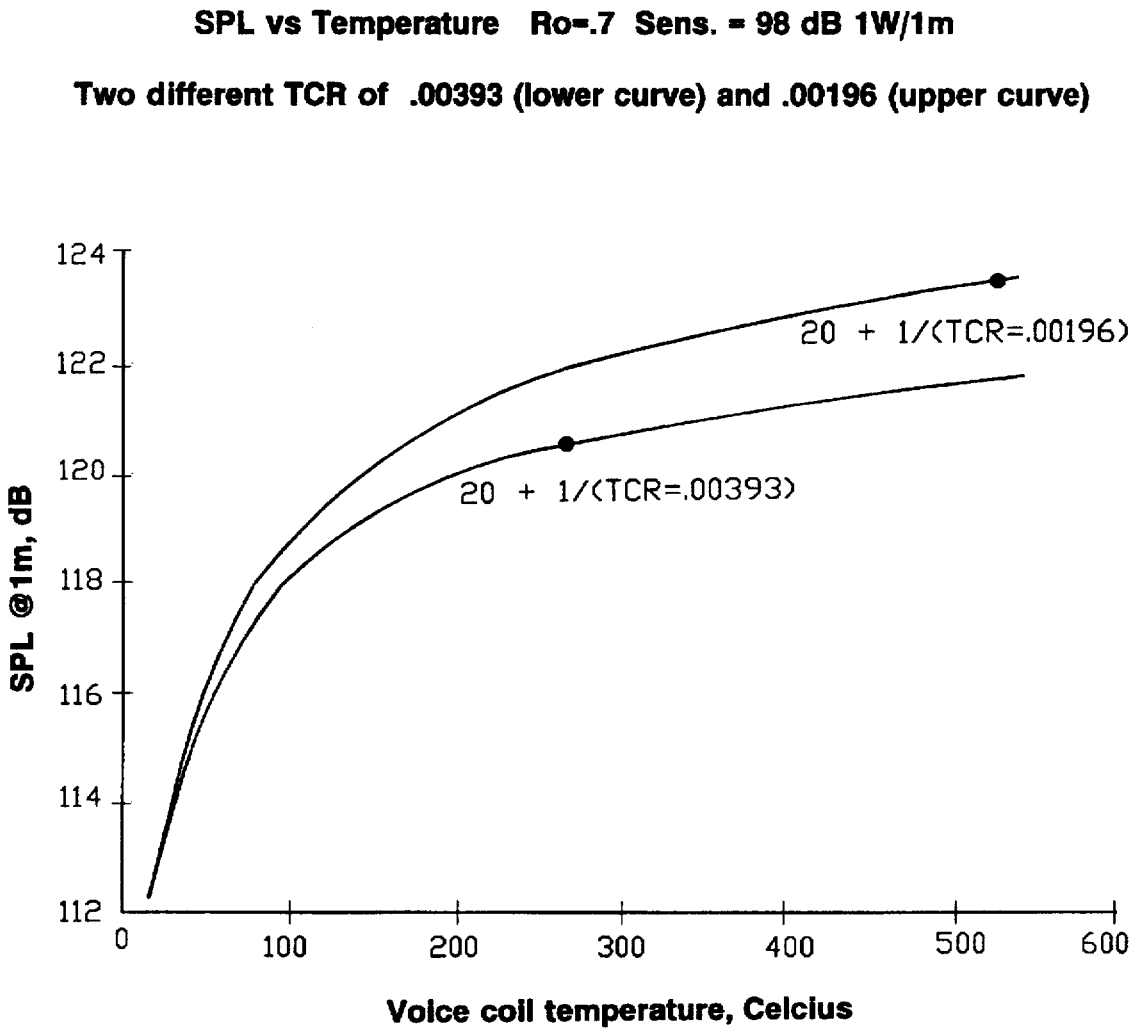
FIG. 3 is a graph showing SPL as a function of voice coil temperature for two voice coil wire materials having different TCR: 0.00393 for Al or Cu, and 0.00196 for Al Mg(3.5%) extruded.

FIG. 1 gives a global equation for SPL as derived in the above-referenced AES paper and includes a glossary of the terms appearing in the equation.

The paper analyses the influence of the various factors and establishes an empirical basis for setting structural loudspeaker parameters at predetermined optimal constant values in order to analyze the relation between voice coil temperature and SPL as a function of the combination of voice coil wire parameters: TCR ($k_1$), resistivity ($k_3$) and density ($k_4$).

The equation of FIG. 1 can be rewritten:

$$SPL=112+10\mathrm{Log}[K_1/(k_1+1/T_r)(M_{mx}+k_2k_3k_4)^2]dB/1\ m\ wherein$$

$K_1=P_oS_d^2R_{me}C_hC_d/2\ cF_c$ and $K_2=k_2C_h^2C^2R_{me}/FX^2F_p$.

$K_1$, $K_2$ and $M_{mx}$ are the structural loudspeaker factors; typical values for a 15" loudspeaker are:

$K_1$=4.54E-04, $K_2$=5.78E04, and $M_{mx}$=0.07.

For the case of theoretical maximum SPL where the temperatures rises to infinity and $1/T_r$ goes to zero:

$$SPL_{MAX}=112+10\mathrm{Log}[K_1k_1(M_{mx}+k_2k_3k_4)^2]dB/1\ m.$$

The above-referenced paper finds that existing technology has plateaued at operating temperatures just about 20+1/TCR, i.e. 264° C., for aluminum and copper: at that temperature (20+1/TCR) the voice coil resistance is twice the initial room temperature (20° C.) value, and thus with constant voltage the power the SPL is reduced to half from the initial value (−3 dB). This point, $SPL_{MAX}$−3 dB, is taken to be the point of maximum available SPL, i.e. the point of maximum working voice coil temperature.

FIG. 2 is a table of properties of pure copper and aluminum and various aluminum alloys that are considered as possible candidates for voice coil wire material. The four columns to the right show published data: TCR (k1), resistivity (k3), specific gravity (shown for reference convenience) and density (k4), while the three columns to the left show data calculated from the equation in FIG. 1, utilizing the simplified version given above along with the typical structural loudspeaker values given. The calculated values are the theoretical maximum $SPL_{MAX}$ (at infinitely high temperature), the available SPL ($SPL_{MAX}$−3 dB) and the corresponding maximum working voice coil temperature.

It is seen that the calculated available SPL is higher for pure aluminum than for pure copper, and that for one of the alloys, Al Mg(3.5) extruded, i.e. extruded alloy of aluminum containing 3.5% magnesium (the 96.5% balance being aluminum), the calculated maximum SPL is 1.5 dB higher than for pure aluminum and 3.32 dB higher than for pure copper. This indicates that this alloy, which has a TCR a little under half that of copper and aluminum and resistivity over three times that of copper and about twice that of aluminum, has the potential of accomplishing an increase of 41.3% over aluminum and an increase of 115% over copper in maximum effective radiated acoustic power capability, provided that the voice coil structure can be made to withstand the increased maximum working temperature level.

Other candidate metal and alloys for maximized SPL voice coil design can be estimated and investigated in the same manner using the equation of FIG. 1: it can be postulated that candidate materials will have a characteristic TCR not exceeding 0.0035, and a product of resistivity times density not exceeding 0.3E-06, in the specified units.

FIG. 3 shows graphically the relationship between voice coil temperature and SPL from the equation of FIG. 1, calculated for two different values of TCR: 0.00393 representing copper and aluminum in the lower curve, and 0.00196 representing the Al Mg(3.5 extruded) alloy. Also shown are the respective maximum working temperature points (20+1/TCR) from FIG. 2, showing the higher working temperature point for the alloy.

In summary it has been discovered and disclosed herein that a fundamental improvement in maximum available SPL may be realized by utilizing materials other than copper or aluminum for voice coil windings, in particular by utilizing an alloy selected to have a lower TCR than that of copper or aluminum along with suitable resistivity and density, as exemplified by the Al Mg(3.5) extruded alloy.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

What is claimed is:

1. An electro-magnetic winding, in a voice coil of a loudspeaker, comprising a metallic wire material selected to have a temperature coefficient of resistance less than 0.0035 per degree C, and to have a product of resistivity in ohm centimeters times density in kilograms/cubic inch less than 0.3E-06, wherein said wire material is selected in a manner to maximize a theoretical maximum sound pressure level $SPL_{MAX}$ in accordance with the following equation:

$$SPL_{MAX}=112+10\mathrm{Log}[K_1/k_1(M_{mx}+k_2k_3k_4)^2]\text{wherein}$$

$SPL_{MAX}$ is the theoretical maximum sound pressure level at infinitely high temperature, dB/1 m, $k_1$ is temperature coefficient of resistance of the wire material, per degree C (20° to 100° C.), $k_3$ is resistivity of the wire material, Ohm-centimeters, $k_4$ is density of the wire material, kilograms/cubic inch, and $K_1$, $M_{mx}$ and $K_2$ are predetermined loudspeaker structural factors.

2. The electro-magnetic winding as defined in claim 1 wherein the loudspeaker structural factors are defined as follows:

$$K_1=P_oS_d^2R_{me}C_hC_d/2\pi cF_c \text{ and } K_2=k_2C_h^2C_d^2R_{me}/FX^2F_p \text{ wherein}$$

$P_o$ is density of air, 1.21 kilograms/cubic meter, $S_d$ is projected diaphragm area, square meters, $R_{me}$ is motor strength defined as $B^2L^2/R_e$, B being coil surface flux density, Tesla, L being coil wire length, meters, and $R_e$ being voice coil DC resistance, Ohms, $C_h$ is coil height (axial length), inches, $C_d$ is voice coil mean diameter, inches, c is speed of sound, 343 meters/second, $F_c$ is coil surface cooling factor, degrees C/Watt, $k_2$ is a modifier for mixed units, 7.84E12, FX is flux lines passing through coil surface, Maxwells, and $F_p$ is packing factor of coil windings (0.95 for edge wound, 0.7 for round wire).

3. The electro-magnetic winding as defined in claim 2 wherein the loudspeaker structural factors are assigned the following values as typical of a principal class of loudspeaker addressed: $K_1$=4.54E-04, $K_2$=5.78E04 and $M_{mx}$= 0.07.

4. The electro-magnetic winding as defined in claim 1 wherein said metallic wire material is an alloy of aluminum selected from the following group: aluminum magnesium, aluminum magnesium silicon, aluminum copper magnesium manganese and aluminum zinc copper manganese magnesium.

5. The electro-magnetic winding as defined in claim 1 wherein said metallic wire material is an alloy of aluminum and magnesium further defined in one of the following classifications: Al Mg(1.25%) in sheet form, Al Mg(1.25%) extruded, Al Mg(2.25%), Al Mg(3.5%) in sheet form and Al Mg(3.5) extruded.

6. The electro-magnetic winding as defined in claim 1 wherein said metallic wire material is an alloy of aluminum, magnesium and silicon further defined as Al Mg(0.5%) Si(0.5%).

7. The electro-magnetic winding as defined in claim 1 wherein said metallic wire material is an alloy of aluminium, copper, magnesium, silicon and manganese further defined as Al Cu(4.0%) Mg(0.6%) Si(0.4%) Mn(0.6%).

8. The electro-magnetic winding as defined in claim 1 wherein said metallic wire material is an alloy of aluminum, zinc, copper, manganese and magnesium further defined as Al Zn(10%) Cu(1.0%) Mn(0.7%) Mg(0.4%).

9. The electro-magnetic winding as defined in claim 1 wherein said metallic wire material is an alloy of aluminum containing at least one additional metal selected from a group consisting of magnesium, silicon, copper, manganese and zinc, said alloy being selected and proportioned so as to provide available SPL that exceeds that of aluminum as calculated from the equation.

* * * * *